United States Patent [19]

DeMars

[11] Patent Number: 4,630,752

[45] Date of Patent: Dec. 23, 1986

[54] TRASH CAN HOOP RETAINER

[76] Inventor: Robert A. DeMars, 7932 Maestro Ave., Canoga Park, Calif. 91304

[21] Appl. No.: 853,956

[22] Filed: Apr. 21, 1986

[51] Int. Cl.[4] ..... B65D 67/12; B65D 45/00

[52] U.S. Cl. ..... 220/404; 220/1 T; 383/33; 24/570

[58] Field of Search ..... 220/404, 1 T; 383/33; 24/488, 492, 570

[56] References Cited

U.S. PATENT DOCUMENTS

| | | | |
|---|---|---|---|
| 1,062,532 | 5/1913 | Blair | 24/570 X |
| 2,145,613 | 1/1939 | Shenk et al. | 220/404 |
| 2,202,238 | 5/1940 | Thompson | 220/404 |
| 3,457,707 | 7/1969 | Fesco | 383/33 X |
| 3,893,649 | 7/1975 | Cornell et al. | 383/33 X |
| 4,279,357 | 7/1981 | Robinson | 220/1 T X |

*Primary Examiner*—Steven M. Pollard

*Attorney, Agent, or Firm*—Cislo, O'Reilly & Thomas

[57] ABSTRACT

A trash can hoop retainer is provided for retaining trash bags in trash cans. Specifically, the retainer of the invention provides a clamping action against the upper portion of the trash bags, which upper portion in draped over the outside edge or rim of the trash can.

The retainer is provided with means for engaging in rotatable, hinged relationship with one handle of the trash can. Means are provided on the retainer opposite the hinge side for engaging the rim of the trash can in clamping relationship.

10 Claims, 3 Drawing Figures

Fig. 1.
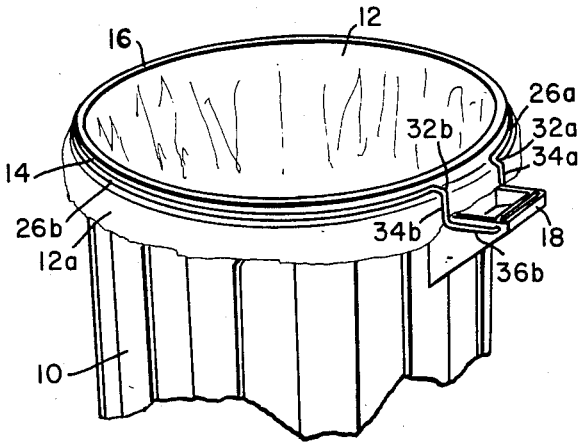
Fig. 2.
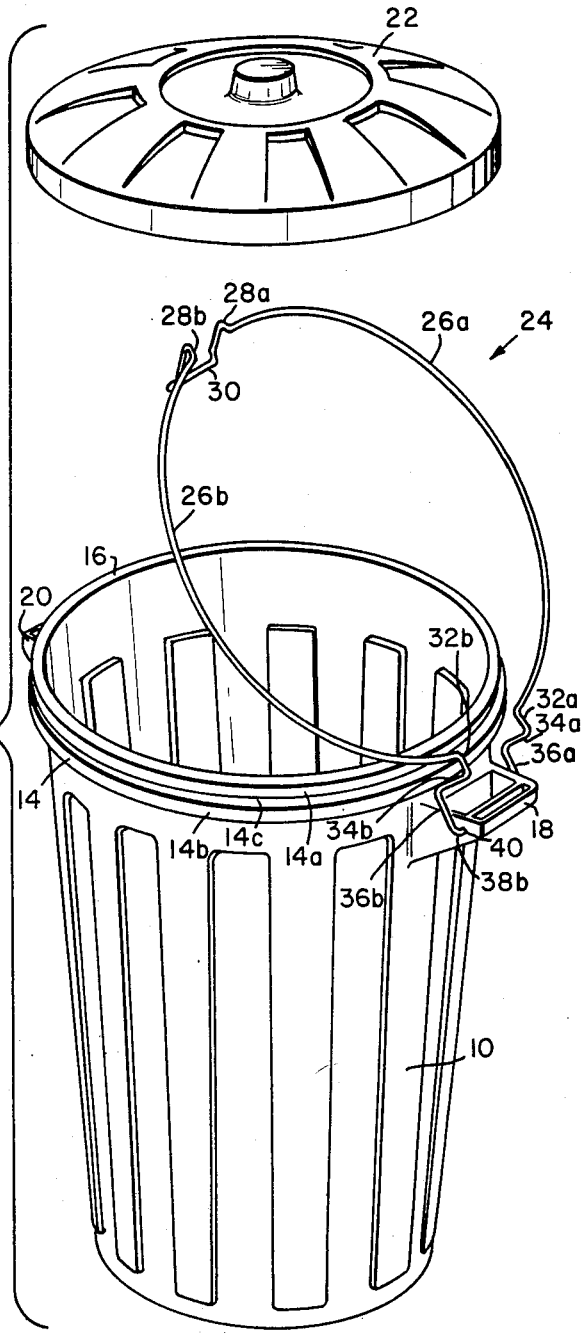
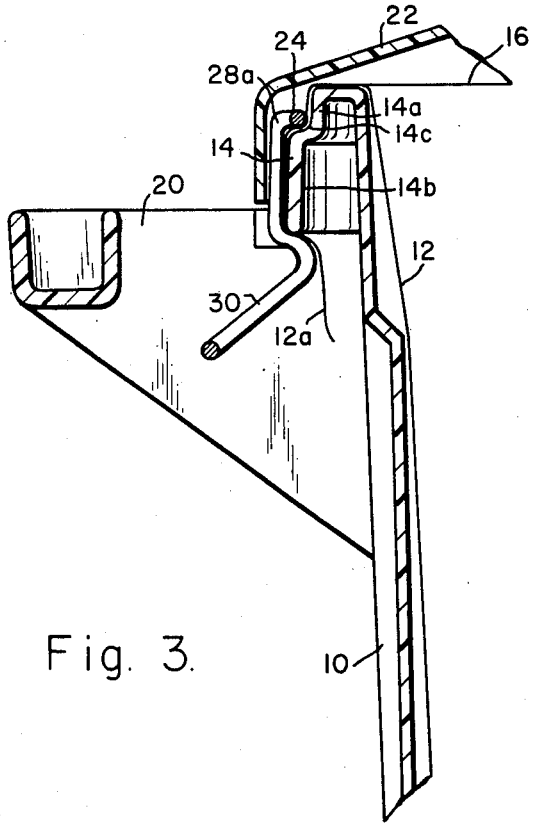
Fig. 3.

TRASH CAN HOOP RETAINER

BACKGROUND OF THE INVENTION

The present invention relates to a hoop retainer for securing disposable trash bags in a trash can.

Trash bags, which typically comprise a flexible plastic material such as mylar, are employed to protect the inside of the trash can and to keep the trash can clean. In the case of metal trash cans, the prevention of garbage and other detritus from contacting the metal sides and bottom will considerably reduce the possibility of corrosion thereof.

Attempts to use disposable trash bags in conjunction with trash cans is often frustrating. Usually, the trash bag is opened and placed in the trash can, and the open end is draped over the open end and upper side of the trash can.

However, the weight of trash often causes the trash bag to partially or completely slip inside the trash can, with the consequence that the trash bag is difficult to retrieve, especially without tearing the trash bag due to the weight of the trash. Such tearing, of course, defeats the purpose of employing the trash bag, and results in dirtying the inside of the trash can.

A means of retaining the trash bag in position is desired that is easy to use and may be retrofitted on existing trash cans.

OBJECTS AND SUMMARY OF THE INVENTION

Accordingly, it is an object of the present invention to provide a trash can retainer.

It is another object of the present invention to provide a trash can retainer in hoop configuration for removeable securement to a trash can.

It is yet another object of the present invention to provide a trash can hoop retainer that is hingedly attachable to the trash can and provided with means for removable retention of trash bags.

It is a further object of the present invention to provide a trash can hoop retainer that may be retrofitted to existing trash cans.

Briefly, a trash can retainer is provided for retaining trash bags in removable securement in a trash can having two lifting handles and a rim. The retainer comprises a rod-like body of substantially circular or hoop-like configuration, with means on one side for hingedly engaging in one of the handles of the trash can and means on the opposite side therefrom to engage the rim above the second of the handles of the trash can in clamping relationship to thereby engage a top portion of the trash bag in friction-fit relationship.

BRIEF DESCRIPTION OF THE DRAWINGS

FIG. 1 is a perspective view of an upper portion of a trash can, with the trash can hoop retainer of the invention shown in clamping position;

FIG. 2 is an exploded view of a trash can and cover, showing the trash can hoop retainer in partially lifted position; and FIG. 3 is a cross-sectional view of the detail of the clamping of the trash can hoop retainer of the invention with respect to a handle of the trash can.

DETAILED DESCRIPTION OF THE INVENTION

Referring now to the drawing wherein like numerals of reference designate like elements throughout, the upper portion of a trash can 10 is depicted in FIG. 1, with a trash bag 12 secured therein. The trash can 10 is of the type provided with an overhanging, downwardly depending rim 14, which defines top 16 of the trash can 10.

The rim 14 may have a downwardly depending portion or skirt, as is common. However, the retainer of the invention will be better maintained in place if, as shown more clearly in FIG. 3, the rim 14 includes an inner downwardly depending portion **14*a* and an outer downwardly depending skirt portion 14*b* connected therewith by a support concavity 14*c*. The retainer may then be supported in the support concavity 14*c***.

The trash can 10 is also provided with a pair of opposed handles 18, 20 and a cover 22. The handles 18, 20 are conveniently made of the same material as the trash can, such as a high impact plastic, although metal, such as galvanized steel, may alternately be employed as either the trash can, the handles or both. The handles are preferably integral with the body of the trash can 10 and extend outwardly therefrom.

In accordance with the invention, a trash can hoop retainer 24 is employed to retain the trash bag 12 in the trash can 10.

FIG. 2 depicts in exploded perspective view the relationship between the trash can 10, its cover 16 and the trash can hoop retainer 24 of the invention. There, it is seen that the retainer 24 is a rod-like body of substantially circular or hoop-like configuration.

The circular configuration is not continuous, however. The retainer 24 comprises two opposed annular members **26*a*, 26*b* joined on one side by outwardly projecting radial members 28*a*, 28*b* integrally formed therewith, in turn connected to either side of a downwardly depending U-shaped member 30, also integrally formed therewith. The U-shaped member 30 is adapted to be cooperatively associated with the bottom of the downwardly depending skirt portion 14*b* of the rim 14** in clamping arrangement.

At the opposite end of the retainer 24, the two opposed annular members **26*a*, 26*b* terminate in open ends, each comprising a first outwardly projecting radial member 32*a*, 32*b*, a downwardly depending member 34*a*, 34*b*, a second outwardly projecting radial member 36*a*, 36*b* in a plane below that defined by the annular members 26*a*, 26*b*, and an inwardly disposed tang member 38*a*, 38*b* (only 38*b* being visible in the drawings), with all members 32*a*, 34*a*, 36*a* and 38*a* being integral with annular member 26*a* and with all members 32*b*, 34*b*, 36*b* and 38*b* being integral with annular member 26*b***.

The tang members **38*a*, 38*b* are cooperatively associated in holes 40 in handle 18 in rotatable relationship, thereby providing a hinge movement to the retainer 24 formed by the axis connecting the holes 40 in the handle 18. Indeed, the retainer 28 may be rotated to a rest position along the side of the trash can 10, downwardly depending from the handle 18. To accommodate such rotation, the holes 40 are slightly larger than the outside diameter of the tang members 38*a*, 38*b***.

Advantageously, a wire of steel or other metal is suitably employed in the fabrication of the retainer 24 of the invention, although certain plastic materials having sufficient strength and adequate resiliency may alternately be utilized.

While new trash cans may be fabricated with the holes 40 suitably located in the handle 18, existing trash cans may be modified to accept the retainer 24 of the invention by drilling holes of an adequate diameter and depth to accommodate the tang members 38*a*, 38*b*.

In operation, a trash bag 12 is opened and placed in the trash can 10, with its upper edges 12*a* draped over the rim 14 thereof. The retainer 24 of the invention is rotated so that it provides clamping along the rim 14 by the annular members 26*a*, 26*b*. In particular, the retainer 24 is maintained in the support concavity 14*c*. The U-shaped member 30 is urged downward so as to engage the bottom of the skirt 14*b* of the rim 14 in friction-fit, clamping relationship.

When it is desired to remove the trash bag 12 from the trash can 10, the U-shaped member 30, being yieldable, is pulled slightly away from the rim 14 to disengage the U-shaped member from the bottom of the skirt 14*b*, and the retainer 24 is rotated out of clamping position and into its rest position along the side of the trash can 10, thereby permitting the trash bag 12 to be lifted out of the trash can 10.

Thus, a trash can hoop retainer has been disclosed. Many changes and modifications will readily occur to those of skill in the art, and all such changes and modifications are within the scope of the invention, as defined by the appended claims.

What is claimed is:

1. A trash can retainer for retaining trash bags in removable securement in a trash can having two lifting handles and a rim, comprising a rod-like body of substantially circular configuration, with means on one side for hingedly engaging in one of said handles of said trash can and means on the opposite side therefrom to engage said rim just above the second of said handles of said trash can in clamping relationship to thereby engage a top portion of said trash bag in friction-fit relationship.

2. The trash can retainer in accordance with claim 1 wherein said rim has a downwardly depending portion.

3. The trash can retainer in accordance with claim 2 wherein said rim includes an inner downwardly depending portion and an outer downwardly depending skirt portion connected therewith by a support concavity which is adapted to support said retainer in friction-fit relationship.

4. The trash can retainer in accordance with claim 1 wherein said retainer comprises two opposed annular members joined on a first side by outwardly projecting radial members integrally formed therewith, in turn connected to either side of a downwardly depending U-shaped member also integrally formed therewith, said U-shaped member adapted to be cooperatively associated with the bottom of said rim in clamping arrangement, said annular members further provided with terminations on a second side opposite said first side, said terminations each comprising a first outwardly projecting radial member, a downwardly depending member, a second outwardly projecting radial member in a plane below that defined by said annular members, and an inwardly disposed tang member, with all members being integral with its adjacent members.

5. The trash can retainer in accordance with claim 4 wherein said handle hingedly engaged by said retainer is provided with holes adapted to receive a tang member cooperatively associated therewith in rotatable relationship to thereby provide a hinge movement to said retainer about an axis connecting said holes in said handle.

6. The trash can retainer in accordance with claim 5 wherein said holes are of a diameter slightly larger than the diameter of said tang members.

7. The trash can retainer in accordance with claim 1 comprising a metal wire.

8. A trash can retainer for retaining trash bags in removable securement in a trash can having two lifting handles and a rim, said rim including an inner downwardly depending portion and an outer downwardly depending skirt portion connected therewith by a support concavity which is adapted to support said retainer in friction-fit relationship, with means on a first side to engage said rim just above one of said handles of said trash can in clamping relationship to thereby engage a top portion of said trash bag in friction-fit relationship and means on a second side opposite said first side for hingedly engaging in holes provided in second of said handles of said trash can, said retainer comprising two opposed annular members joined on first side by outwardly projecting radial members integrally formed therewith, in turn connected to either side of a downwardly depending U-shaped member also integrally formed therewith, said U-shaped member adapted to be cooperatively associated with the bottom of said rim in clamping arrangement, said annular members further provided with terminations on said second side, said terminations each comprising a first outwardly projecting radial member, a downwardly depending member, a second outwardly projecting radial member in a plane below that defined by said annular members, and an inwardly disposed tang member, with all members being integral with its adjacent members, said holes in said second handle hingedly engaged by said retainer adapted to receive said tang member cooperatively associated therewith in rotatable relationship to thereby provide a hinge movement of said retainer about an axis connecting said holes in said second handle.

9. The trash can retainer in accordance with claim 8 wherein said holes are of a diameter slightly larger than the diameter of said tang members.

10. The trash can retainer in accordance with claim 8 comprising a metal wire.

* * * * *